US008266835B2

(12) United States Patent
Pintar et al.

(10) Patent No.: US 8,266,835 B2
(45) **Date of Patent: *Sep. 18, 2012**

(54) FIREARM SECURITY DEVICE

(76) Inventors: Kevin B. Pintar, Boise, ID (US); Robert W. Corrigan, Boise, ID (US)

( * ) Notice: Subject to any disclaimer, the term of this patent is extended or adjusted under 35 U.S.C. 154(b) by 284 days.

This patent is subject to a terminal disclaimer.

(21) Appl. No.: 12/683,148

(22) Filed: Jan. 6, 2010

(65) Prior Publication Data

US 2010/0107465 A1 May 6, 2010

Related U.S. Application Data

(63) Continuation-in-part of application No. 12/022,534, filed on Jan. 30, 2008, now Pat. No. 7,658,028.

(60) Provisional application No. 60/887,393, filed on Jan. 31, 2007.

(51) Int. Cl.
*F41A 17/00* (2006.01)

(52) U.S. Cl. ..... 42/70.07; 42/70.06; 42/70.11

(58) Field of Classification Search ..... None
See application file for complete search history.

(56) References Cited

U.S. PATENT DOCUMENTS

| | | | | |
|---|---|---|---|---|
| 321,930 | A | | 7/1885 | Wunderlick |
| 795,566 | A | | 7/1905 | Wallace |
| 2,593,402 | A | | 4/1952 | Aitchison et al. |
| 2,752,046 | A | | 6/1956 | Levy |
| 2,998,885 | A | | 9/1961 | Surface |
| 3,007,581 | A | | 11/1961 | Moore |
| 3,876,078 | A | | 4/1975 | Gomes et al. |
| 4,113,107 | A | | 9/1978 | Jaeger |
| 4,182,453 | A | | 1/1980 | Worswick |
| 4,461,385 | A | | 7/1984 | Clouser |
| 4,579,263 | A | | 4/1986 | Ehmke et al. |
| 4,696,405 | A | | 9/1987 | Waring |
| 4,986,427 | A | | 1/1991 | Law et al. |
| 5,022,536 | A | | 6/1991 | Pierson |
| 5,138,786 | A | | 8/1992 | Fischer |
| 5,263,592 | A | | 11/1993 | Dingee, Jr. |
| 5,350,094 | A | | 9/1994 | Morford |
| 5,443,191 | A | | 8/1995 | Jorgenson |
| 5,454,931 | A | | 10/1995 | Lauve |
| 5,561,935 | A | * | 10/1996 | McCarthy et al. ..... 42/70.07 |
| 5,621,996 | A | * | 4/1997 | Mowl, Jr. ..... 42/70.07 |
| 5,768,819 | A | | 6/1998 | Neal |
| 5,791,499 | A | | 8/1998 | Aebbedies |
| 5,797,500 | A | | 8/1998 | Lacoste |
| 5,899,102 | A | * | 5/1999 | Ling ..... 70/312 |
| 5,918,402 | A | * | 7/1999 | Weinraub ..... 42/70.07 |
| 6,047,870 | A | | 4/2000 | Morford |
| 6,206,261 | B1 | | 3/2001 | McCrary |

(Continued)

*Primary Examiner* — Michael Carone
*Assistant Examiner* — Samir Abdosh
(74) *Attorney, Agent, or Firm* — Parsons Behle & Latimer

(57) ABSTRACT

A firearm security device including a surface mountable frame to which a first plate and a second movable plate are attached. A grip pad is attached to each of the opposing inner sides of the fixed and movable plates. A trigger guard stud is attached to and projects from the inner face of the fixed plate. The movable second plate is movable with respect to the first plate from an open position wherein a firearm is positioned with the trigger guard stud projecting through the trigger guard of the firearm, to a closed position where the movable plate is positioned substantially parallel to the fixed plate and at least a portion of the receiver of the firearm is held in a compressive grip between the grip pads. A lock selectively restricts movement of the second movable plate.

20 Claims, 10 Drawing Sheets

U.S. PATENT DOCUMENTS

| | | | | |
|---|---|---|---|---|
| 6,360,931 | B1 | 3/2002 | Morford | |
| 6,364,339 | B1 | 4/2002 | Lee | |
| 6,543,260 | B2 | 4/2003 | Koy et al. | |
| 6,584,719 | B1 | 7/2003 | Morford | |
| 6,585,209 | B1 | 7/2003 | Mattingly | |
| 6,601,332 | B1 * | 8/2003 | Riebling | 42/70.11 |
| 7,047,771 | B2 | 5/2006 | Tanos | |
| 7,367,150 | B2 * | 5/2008 | Farchione et al. | 42/70.07 |
| 2002/0069569 | A1 * | 6/2002 | Riebling et al. | 42/70.07 |
| 2002/0133998 | A1 * | 9/2002 | Murray et al. | 42/70.07 |
| 2004/0216349 | A1 * | 11/2004 | Riebling et al. | 42/70.07 |

* cited by examiner

FIREARM SECURITY DEVICE

RELATED APPLICATIONS

This application is a continuation-in-part of and claims the benefit and priority of U.S. patent application Ser. No. 12/022,534 entitled Firearm Security Device, filed Jan. 30, 2008, now U.S. Pat. No. 7,658,028 which claims the priority of Provisional Application Ser. No. 60/887,393 entitled Firearm Security Device, filed Jan. 31, 2007, the content of said application being incorporated herein by reference.

BACKGROUND OF THE INVENTION

1. Field of the Invention

This invention relates to firearm security devices, and more particularly to a firearm security device for holding a firearm in a secure manner.

2. Background

The prior art includes a variety of gun racks configured for displaying, holding or securing a variety of firearms. Additionally, the prior art includes a variety of firearm locking assemblies including several that lock through the trigger guard as demonstrated by the lock and chain arrangement shown in U.S. Pat. No. 4,461,385 to Clouser, and the cable and lock arrangement shown in U.S. Pat. No. 5,263,592 issued to Dingee, Jr.

Additionally many firearms are configured to permit a rapid knockdown of various components including the upper receiver, ammo clips, barrel sections and stock members. Many of the firearm securing devices of the prior art, while capable of securing a firearm in toto, do not prevent against the removal of component parts that are designed for rapid knockdown.

It would be desirable to provide a firearm security device that is configured to secure a firearm in a manner that allows a secure placement or location of the firearm and which also provides the option of allowing the firearm to be locked in the firearm security device thereby increasing firearm security. Additionally, it may be desirable to provide a firearm security device that is specifically adapted to various tactical weapons utilized by the military and law enforcement personnel.

One object of the present invention is to provide a firearm security device that is adaptable to secure a wide variety of firearms, including pistols, rifles, including tactical rifles and shotguns. Another objective of the present invention is to provide a firearm security device that may be configured or adapted to prevent removal of component parts of the firearm while the firearm is secured in the device. Another objective of the present invention is to provide a firearm security device that may be adapted to various tactical weapons utilized by the military and law enforcement personnel.

SUMMARY OF THE INVENTION

The present invention is directed to a firearm security device that includes a fixed plate attached to a frame member and a movable plate also attached to a frame member. A grip pad is attached to and covers an inner surface of the fixed plate. Similarly, a grip pad is attached to and covers an inner surface of the movable plate. A trigger guard stud is attached to the fixed plate projecting from the inner face of the fixed plate. The trigger guard stud is adapted for insertion through the trigger guard of the firearm. Preferably, the trigger guard stud includes a case hardened steel post that is surrounded by a pad. The movable plate is movable in the sense that it may be shifted from an opened position where a firearm may be placed into or removed from the device, to a closed position wherein at least a portion of the receiver of the firearm is held in a compressive grip between the grip pads.

A plate shifting assembly may be attached to the frame and the movable plate and is adapted to reposition the movable plate from an open position wherein the firearm may be positioned with the trigger guard stud projecting through the trigger guard of the firearm, to a closed position wherein the movable plate is positioned in a closed position substantially parallel to and opposing the fixed plate. In the preferred embodiment of the invention, the plate shifting assembly is configured as a clamping assembly having an over-center clamping action. Other linkages, mechanisms and means may perform the function of the plate shifting assembly, for instance a four-bar linkage may be adapted to the device to shift the movable plate from the opened to the closed position. Similarly, any number of mechanical, electrical, hydraulic or pneumatic devices and assemblies may be adapted to the function.

The preferred embodiment of the firearm security device also includes a firearm support member connected to the fixed plate and adapted to support the firearm below the receiver. In one embodiment, the firearm support member is configured as a receiver support pad that is attached to the fixed plate projecting from the inner face of the fixed plate. Preferably, the receiver support pad includes a rigid post that secures the pad to the fixed plate. The receiver support stud is adapted for positioning to the rear of the receiver of the firearm.

Alternately, the firearm support member may be configured as a rifle/shotgun adapter that is adapted to grasp an upper and a lower surface of the grip portion of a rifle or shotgun stock.

In the preferred embodiment, the firearm security device includes a base assembly to which a frame member is pivotably attached. The base assembly provides means for attaching the firearm security device to a surface. The pivotability of the base assembly permits the adjustment of the angle of the frame to the base to permit customization of installation.

In the preferred embodiment of the invention, the grip pads, the pads of the trigger guard stud and the receiver support stud and the rifle/shotgun adapter are all formed of a vibration resistant polymeric material that will not react to the materials, surfaces and finished employed in firearm manufacture. The grip pads may be configured to accommodate various surface features and mechanisms located on or projecting from the side of the receiver portion of the firearm that the grip pad is to be positioned against.

The preferred embodiment of the firearm security device also includes a locking mechanism that is adapted to selectively restrict movement of the movable plate relative to the opposing fixed plate. Thus when the firearm security device is locked neither the firearm itself nor parts that are designed for rapid knock-down, disassembly or removal may be accessed for such rapid knock-down, disassembly or removal. Depending on the needs of a particular owner, the lock may be configured as a simple keyed or combination padlock, as a cylinder lock having an axially actuated bolt, or as an electrically operated or electronically or magnetically controlled device.

In the preferred embodiment a distance between the fixed plate and the movable plate in a closed position, with both the fixed plate and the movable plate positioned substantially parallel to one another, is adjustable to accommodate firearms having receivers of various widths.

DETAILED DESCRIPTION

Figure 3:
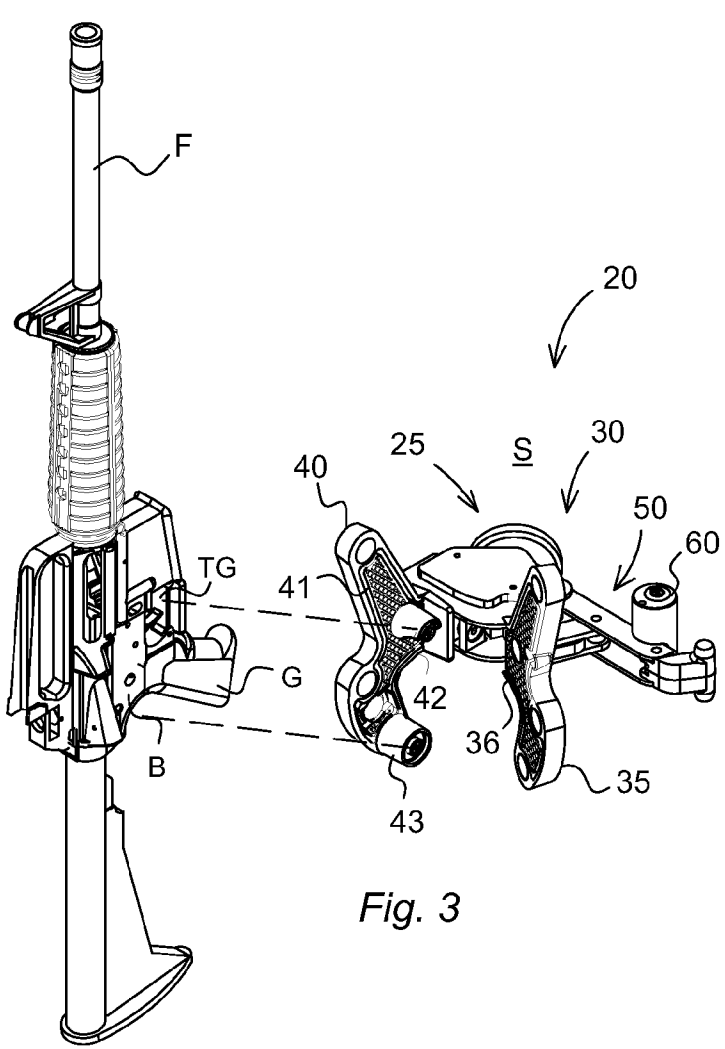
FIG. 3 is a representative perspective view of a firearm security device according to a preferred embodiment of the present invention.
Figure 2:
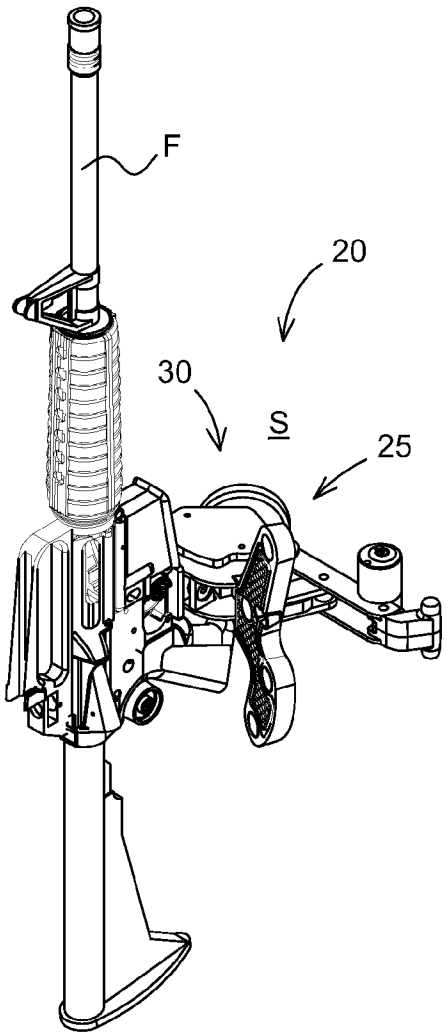
FIG. 2 is a representative perspective view of a firearm security device according to a preferred embodiment of the present invention.
Figure 1:
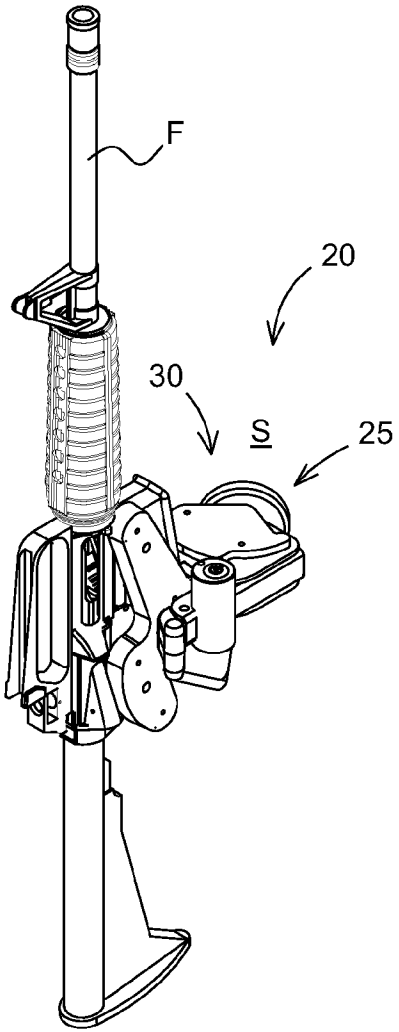
FIG. 1 is a representative perspective view of a firearm security device according to a preferred embodiment of the present invention.

Referring to FIGS. 1 through 3 firearm security device 20 will be described in further detail. As shown in FIGS. 1 through 3, firearm security device 20 includes frame assembly 30. Frame assembly 30 is pivotably connected to base assembly 25. Base assembly 25 of firearm security device 20 mounts to a surface S. A firearm, in this case assault rifle R is shown secured in firearm security device 20.

FIG. 3 shows movable plate 35 shifted away from fixed plate 40 by operation of clamping assembly 50, which in the preferred embodiment provides the plate shifting assembly. Firearm F is shown removed from firearm security device 20. As shown in FIG. 3, fixed plate 40 includes first grip pad 41 attached to an inward facing surface of fixed plate 40. Similarly, movable plate 35 includes second grip pad 36 attached to an inward facing surface of movable plate 35, second grip pad 36 having a generally opposing orientation to first grip pad 41. Trigger guard pad 42 and grip support pad 43 are attached to fixed plate 40 and project from an inner surface of first grip pad 41.

To secure firearm F with firearm security device 20, and with continuing reference to FIG. 3, firearm F is positioned such that trigger guard pad 42 is inserted through trigger guard TG and grip G is positioned so that a rear portion of receiver B rests on top of grip support pad 43. Movable plate 35 is pivotably shifted towards fixed plate 40 by operation of clamping assembly 50 and firearm F is thereby secured in firearm security device 20. In the preferred embodiment, clamping assembly 50 is designed having an over-center clamping action such that when the linkage is advanced to an over-center position, clamping assembly 50 remains in a positive locked position, exerting a compressive gripping force between movable plate 35 and fixed plate 40.

In the preferred embodiment, fixed plate 40 including its attached first grip pad 41 and movable plate 35 including its attached second grip pad 36 are configured such that any and all firearm knock-down mechanisms including pins, pulls, latches and releases for barrels, stocks and magazines or the like are covered when firearm F, in this case an assault rifle is secured in firearm security device 20. It should also be noted that the device shown in FIGS. 1-3 is also adapted to secure many pistols that include a trigger guard through which trigger guard pad 42 would be insertable. Similarly it should also be noted that movable plate 35 and fixed plate 40 as well as second grip pad 36 and first grip pad 41 may all be customized for a particular firearm or need and still be considered within the scope of the present invention.

Firearm security device 20 is adapted to selectively lock the fixed and movable plate 35 and fixed plate 40 in the closed position employing, in the case of the preferred embodiment, tubular lock 60 that includes an axially actuated bolt.

Figure 5:
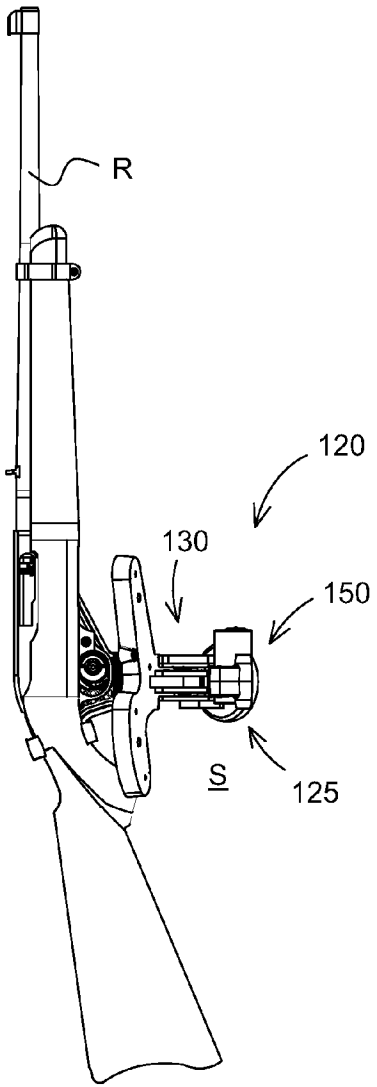
FIG. 5 is a representative side view of a firearm security device according to one preferred embodiment of the present invention.
Figure 4:
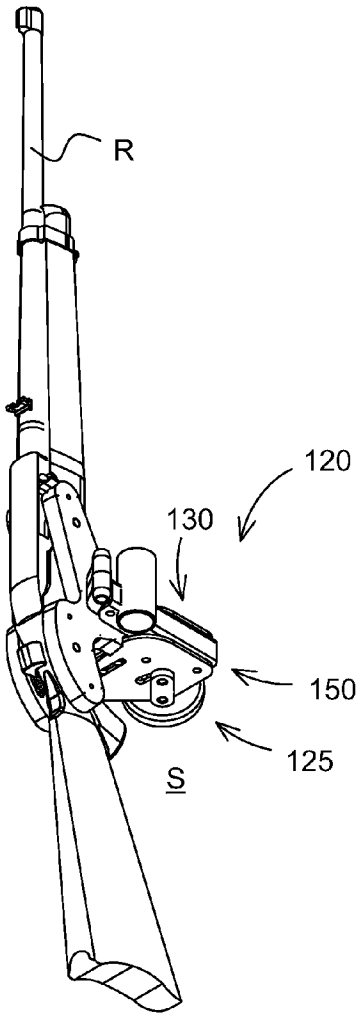
FIG. 4 is a representative perspective view of a firearm security device according to one preferred embodiment of the present invention.

FIGS. 4 and 5 show firearm R in this case a shotgun having a receiver B and a rifle type stock RS with grip portion G, held by firearm security device 120. As shown in FIGS. 3 through 6, firearm security device 120 includes frame assembly 130. Frame assembly 130 is pivotably connected to base assembly 125. Base assembly 125 of firearm security device 120 mounts to a surface S.

Figure 6:
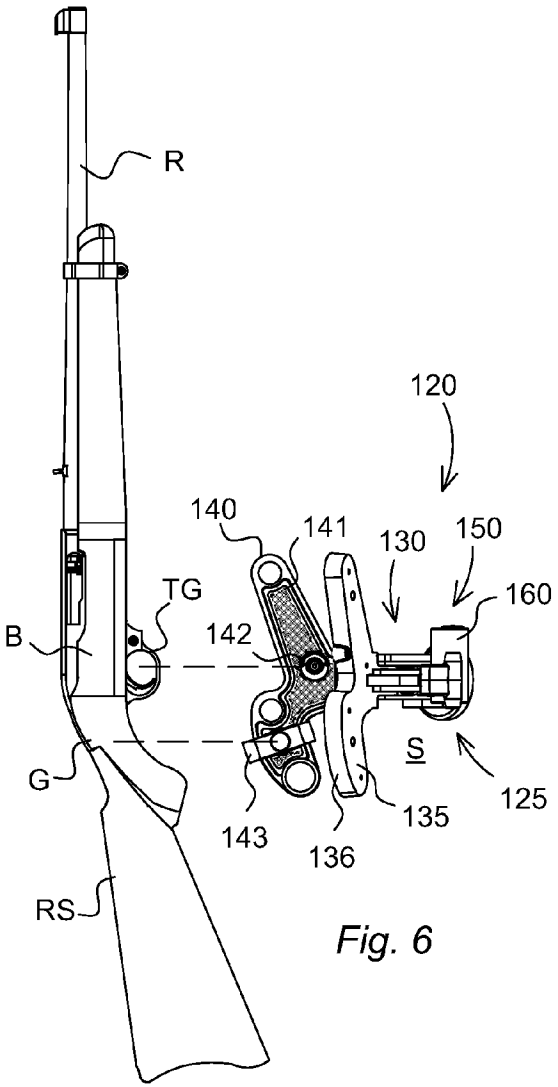
FIG. 6 is representative side view of firearm security device according to one preferred embodiment of the present invention.

FIG. 6 shows movable plate 135 shifted away from fixed plate 140 by operation of clamping assembly 150, which in the preferred embodiment provides the plate shifting assembly. Firearm R is shown removed from firearm security device 120. Movable plate 135 is may be pivotably shifted towards fixed plate 140 by operation of clamping assembly 150 which includes an over-center clamping action clamping assembly 150 remains in a positive locked position in the absence of continued pressure, exerting a compressive gripping force between movable plate 135 and fixed plate 140.

As shown in FIG. 6, fixed plate 140 includes first grip pad 141 attached to an inward facing surface of fixed plate 140. Similarly, movable plate 135 includes second grip pad 136 attached to an inward facing surface of movable plate 135. Second grip pad 136 has a generally opposing orientation to first grip pad 141. Trigger guard stud 142 and rifle/shotgun adapter 143 are attached to fixed plate 140 and project from an inner surface of first grip pad 141.

As shown in FIG. 6, trigger guard stud 142 is adapted to project through trigger guard TG of firearm R and while rifle/shotgun adapter 143 is adapted to grasp firearm R about grip portion G of the stock RS. Firearm security device 120 is adapted to permit locking movable plate 135 and fixed plate 140 in the closed position employing, in the case of the preferred embodiment, tubular lock 160 that includes an axially actuated bolt.

Second grip pad 136, first grip pad 141, trigger guard stud 142, rifle/shotgun adapter 143, and referring to FIG. 3, second grip pad 36, first grip pad 41, trigger guard pad 42 and grip support pad 43 are all preferably formed of a polymeric material exhibiting good vibration isolation characteristics and design. Also in the preferred embodiment, the second grip pad 36, first grip pad 41, trigger guard pad 42 and grip support pad 43 are each formed of a no-marring material that does not react with metal and metal finishes commonly used on firearm parts or wood and finishes used on wood parts for firearms.

Figure 8:
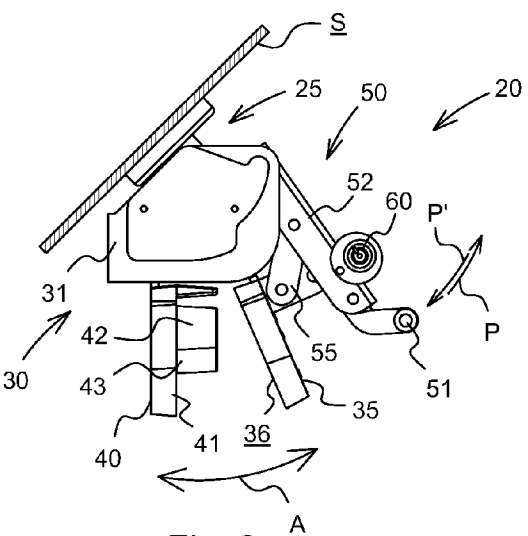
FIG. 8 is a representative top view of a firearm security device according to one preferred embodiment of the present invention.
Figure 7:
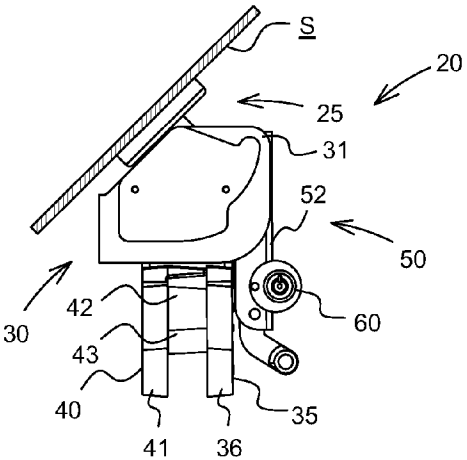
FIG. 7 is a representative top view of a firearm security device according to one preferred embodiment of the present invention.
Figure 9:
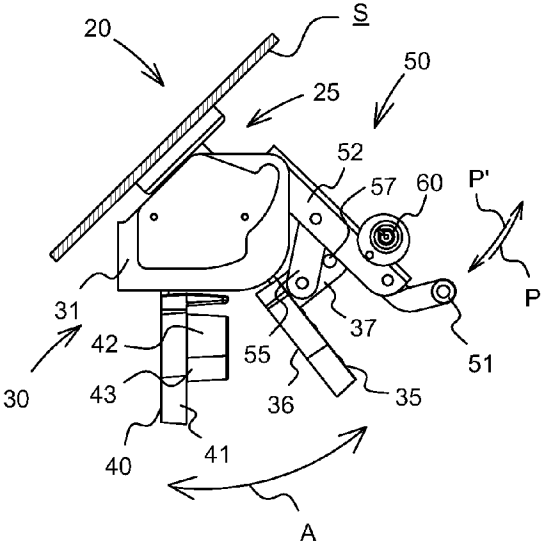
FIG. 9 is a representative top view of a firearm security device according to one preferred embodiment of the present invention.
Figure 11:
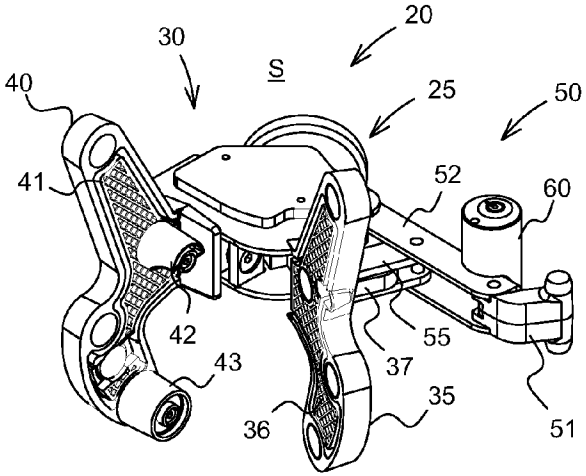
FIG. 11 is a representative perspective view of a firearm security device according to one preferred embodiment of the present invention.
Figure 12:
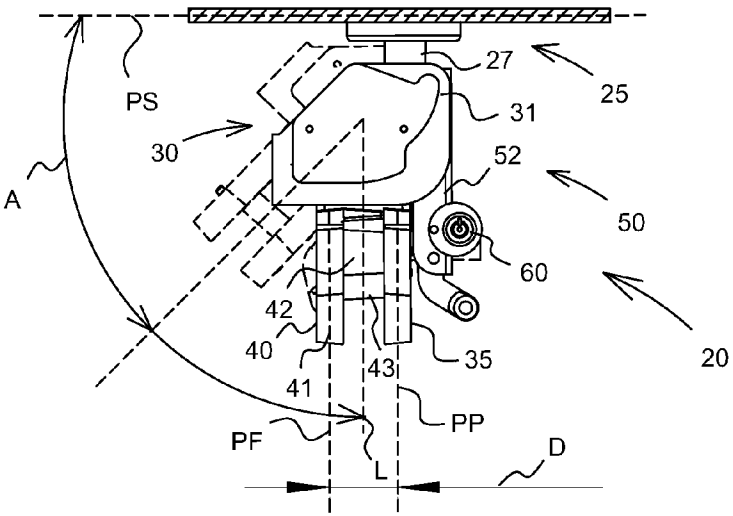
FIG. 12 is a representative top view of a firearm security device according to one preferred embodiment of the present invention.
Figure 10:
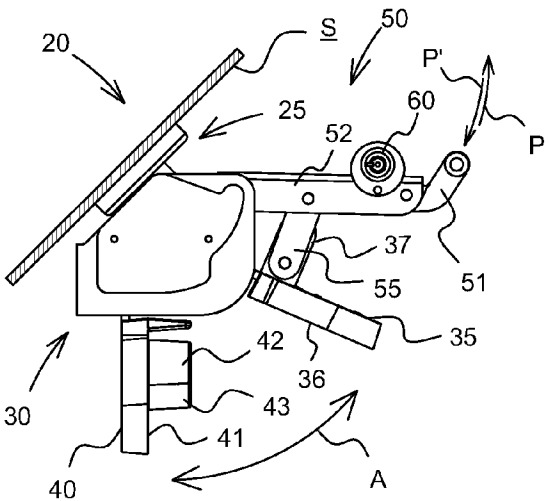
FIG. 10 is a representative top view of a firearm security device according to one preferred embodiment of the present invention.

FIGS. 7 through 12 are a series of views showing firearm security device 20 to advantage. Firearm security device 20 includes frame assembly 30. Frame assembly 30 includes frame member 31 which is pivotably connected to base assembly 25. Base assembly 25 of firearm security device 20 mounts to a surface S. Second grip pad 36 is shown attached to movable plate 35. Trigger guard stud 42 and grip support pad 43 are attached to fixed plate 40 and project from an inner surface of first grip pad 41. Movable plate 35 is shifted from a closed position as seen in FIG. 7 to an open position, as seen in FIGS. 10 and 12, by operation of clamping assembly 50. In the preferred embodiment, tubular lock 60 is attached to lever 52.

FIG. 7 shows movable plate 35 in a substantially parallel position relative to fixed plate 40. In this position, a firearm, (not shown in FIG. 7), may be secured between movable plate 35 and fixed plate 40.

FIGS. 8 and 9 show firearm security device 20 with movable plate 35 shifted to an increasingly opened position. A pulling force, indicated by the vector P is applied to pull 51 causing movable plate 35 to articulate along arc A. Linkage 55 can be seen connecting lever 52 to movable plate 35. More particularly, as shown in FIG. 9, linkage 55 extends between lever 52 and tab 37 which is attached to and extends from movable plate 35. As pulling force P is applied to pull 51 of lever 52 and a force is transmitted to movable plate 35 through linkage 55 and tab 37. Aperture 57 located at a distal end of tab 37 can be seen in FIG. 9. In the fully closed position shown in FIG. 7, tab 37 extends through a slot, (not shown), in lever 52 and aperture 57 aligns with a bolt, (not shown), of lock 60.

FIGS. 10 and 11 show firearm security device 20 with movable plate 35 shifted to a fully opened position. In the fully opened position, a firearm, (not shown in FIG. 10), may be positioned or removed from between movable plate 35 and fixed plate 40. To secure a firearm, between movable plate 35 and fixed plate 40, a pushing force, indicated by the vector P', shown in FIGS. 8-10, is applied to pull 51 causing movable plate 35 to articulate along an arc indicated by the arc A, shown in FIGS. 8-10, to a closed position as seen in FIG. 7.

FIG. 12 is a top elevational view of firearm security device 20 that shows the adjustable relationship between frame member 31 and spindle 27 of base assembly 25. This feature of the device allows a user to adjust an angle A between a line L parallel to the faces of movable plate 35 and fixed plate 40 and a primary plane PS of surface S. FIG. 12 also shows the substantially parallel and opposing orientation of movable plate 35 and fixed plate 40 as shown by line PF that lies parallel to a primary plane of fixed plate 40 and line PP that lies parallel to a primary plane of movable plate 35. Distance D between movable plate 35 and fixed plate 40 can be varied to accommodate firearms having receivers of a variety of widths.

Figure 13:
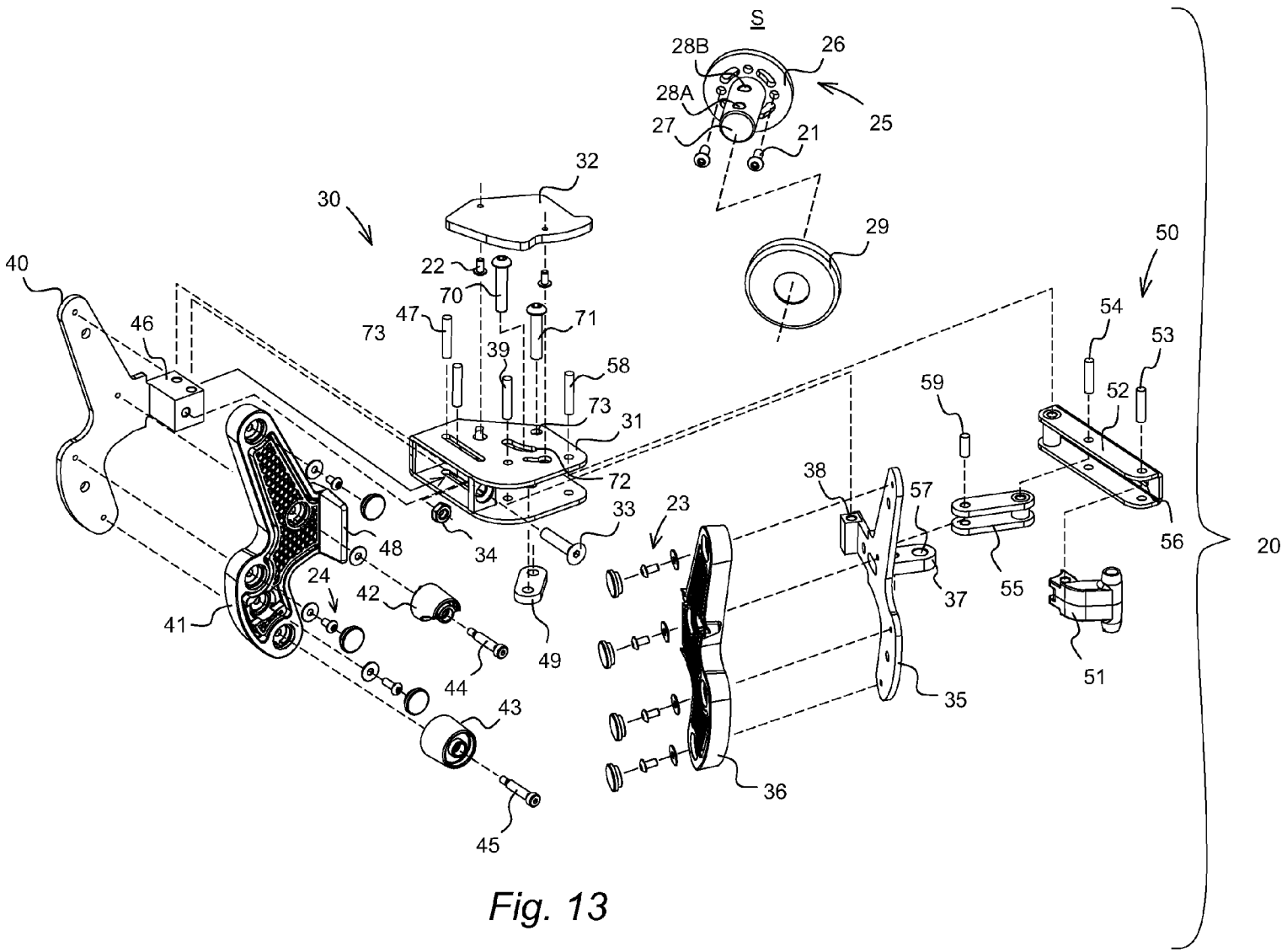
FIG. 13 is a representative exploded view of a firearm security device according to one preferred embodiment of the present invention.

FIG. 13 is an exploded view of firearm security device 20. Firearm security device 20 includes movable plate 35 and fixed plate 40 connected to frame member 31 of frame assembly 30. Second grip pad 36 is attached to movable plate 35 by a plurality of screw and plug assemblies of which screw and plug assembly 23 is typical. Similarly, first grip pad 41 is attached to fixed plate 40 by a plurality of screw and plug assemblies of which screw and plug assembly 24 is typical. Trigger guard stud 42 attaches to fixed plate 40 with screw 44. Similarly, grip support pad 43 attaches to fixed plate 40 with screw 45. In the preferred embodiment, screws 44 and 45 are hardened steel screws. Bumper 48 extends from the face of first grip pad 41 and protects the trigger guard of a firearm from contact with frame member 31.

Frame assembly 30 is pivotably connected to base assembly 25. Spindle 27 extends from base portion 26 which is in turn attached to surface S. Base security cover 29 is placed over spindle 27 covering base portion 26 and screws 21. It should be noted that surface S may include any of a variety of surfaces including flat or curving surfaces, extruded or otherwise formed tracks, channels and modular systems to which base portion 26 and screws 21 may be adapted to secure firearm security device 20 to such surface.

A pair of screws 70 and 71, project through slotted aperture 72 and pivot aperture 73 of frame member 31 and a pair of apertures 28A and 28B of spindle 27, connecting to backing strip 49. Frame security cover plate 32 attaches to frame member 31 with screws 22 covering and securing screws 70 and 71 from removal.

Fixed plate 40 is attached to slide block 46 which in turn is slideably mounted to frame member 31. A pair of pins typified by pin 47 insert through frame member 31 and slide block 46. Adjustment screw 33 threadedly engages slide block 46. In moving adjustment screw 33 in or out, the location of fixed plate with respect to frame member 31 is adjusted and thereby the distance between fixed plate 40 and movable plate 35 may be varied to accommodate the receivers of various firearms having different widths. Once fixed plate 40 is adjusted laterally with respect to frame member 31, lock nut 34 is tightened to maintain the desired position.

Movable plate 35 is attached to block 38 which, in turn is mounted to frame member 31. Pin 39 inserts through frame member 31 and block 38 permitting pivotal movement of movable plate 35 about pin 39.

Movable plate 35 is shifted with respect to fixed plate 40 by operation of clamping assembly 50. Clamping assembly 50 includes pull 51 located at the end of lever 52. In the described embodiment, pull 51 is attached at the end of lever 52 with pin 53. Lever 52 is pivotably attached to frame member 31 by pin 58. Lever 52 is also pivotably attached to movable plate 35 via linkage 55. More particularly linkage 55 is pivotably attached to lever 52 by pin 54 and to tab 37 which is attached to and extends from movable plate 35, by pin 59. Aperture 57 located at a distal end of tab 37 is adapted to project slot 56 located in lever 52 and is engageable with a lock to control access to a stored firearm. It should be noted that any of a variety of locks may be employed with the present invention including keyed and combination padlocks, electrically, electronically or magnetically controlled locks and locks of a variety of configurations depending the requirements of the user.

Figure 14:
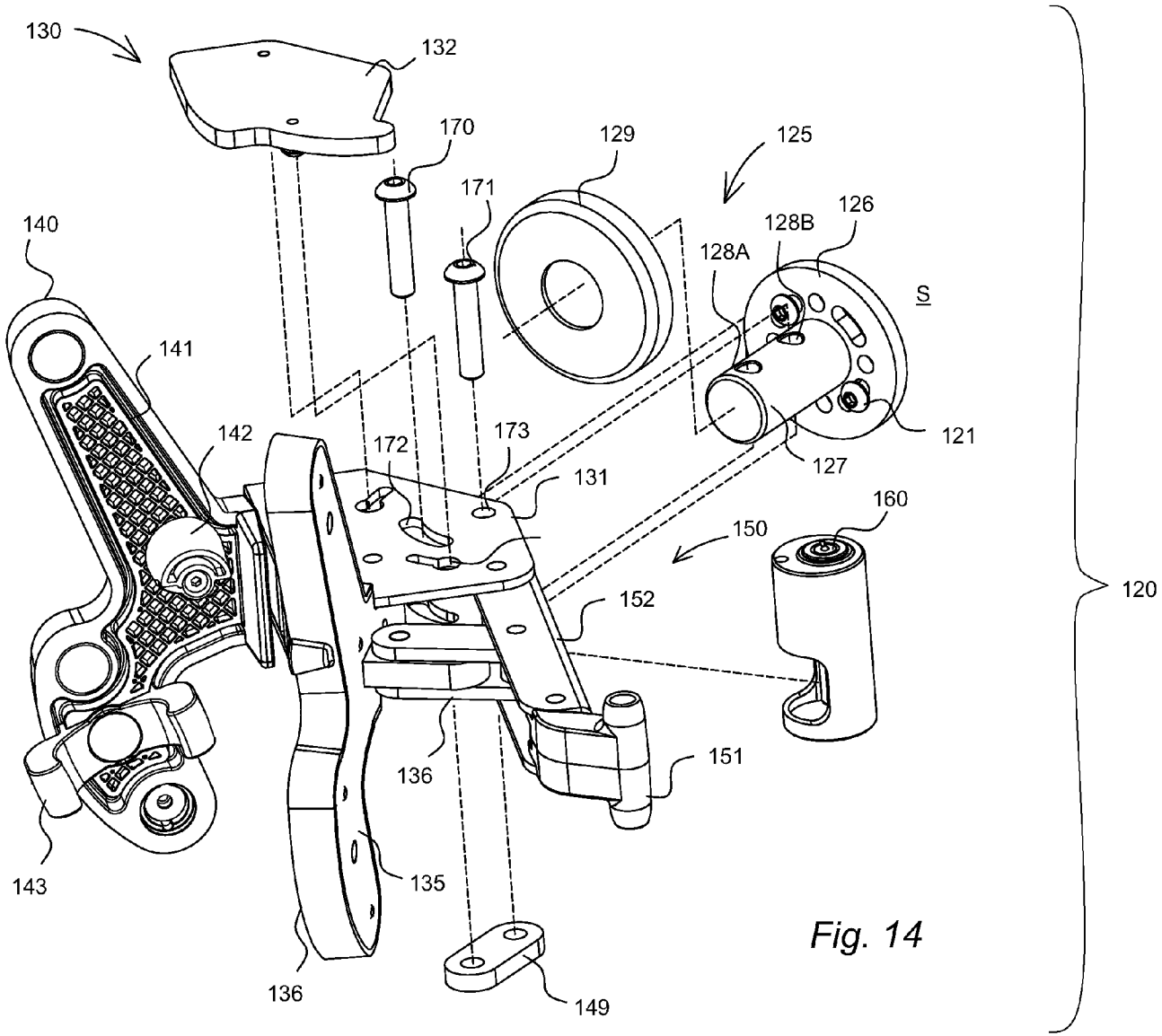
FIG. 14 is a representative exploded view of a firearm security device according to one preferred embodiment of the present invention.

FIG. 14 is a partially exploded view of firearm security device 120. Firearm security device 120 includes movable plate 135 and fixed plate 140 connected to frame member 131 of frame assembly 130. Second grip pad 136 is attached to movable plate 135 and first grip pad 141 is attached to fixed plate 140. Fixed plate 140 includes trigger guard stud 142 and rifle/shotgun adapter 143. Frame assembly 130 is pivotably connected to base assembly 125. Spindle 127 extends from base portion 126 which is in turn attached to surface S. Base security cover 129 is placed over spindle 127 covering base portion 126 and screws 121. A pair of screws 170 and 171, project through slotted aperture 172 and pivot aperture 173 of frame member 131 and a pair of apertures 128A and 128B of spindle 127, connecting to backing strip 149. When installing, the angle between frame member 131 and spindle 127 is adjusted to a desired angle and screw 170 is tightened fixing the angle. Frame security cover plate 132 attaches to frame member 131 covering and securing screws 170 and 171 from removal. Movable plate 135 is shifted with respect to fixed plate 140 by operation of clamping assembly 150. Pull 151 of lever 152 is pulled and lever 152, which is pivotably attached to frame member 131, and movable plate 135, attached to lever 152 by linkage 155, pivots to an opened position as shown in FIG. 14 Lock assembly 160 is mountable to lever 152.

Figure 16:
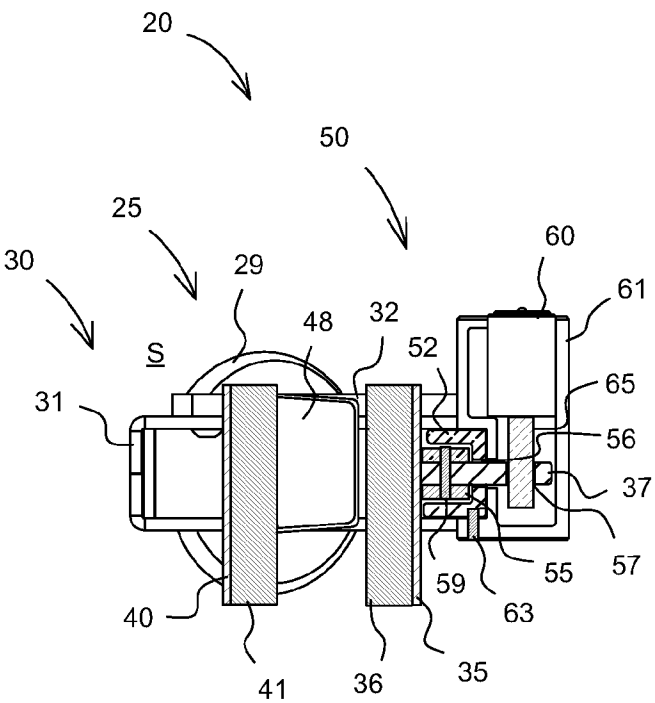
FIG. 16 is a representative front cutaway view of a firearm security device according to one preferred embodiment of the present invention.
Figure 15:
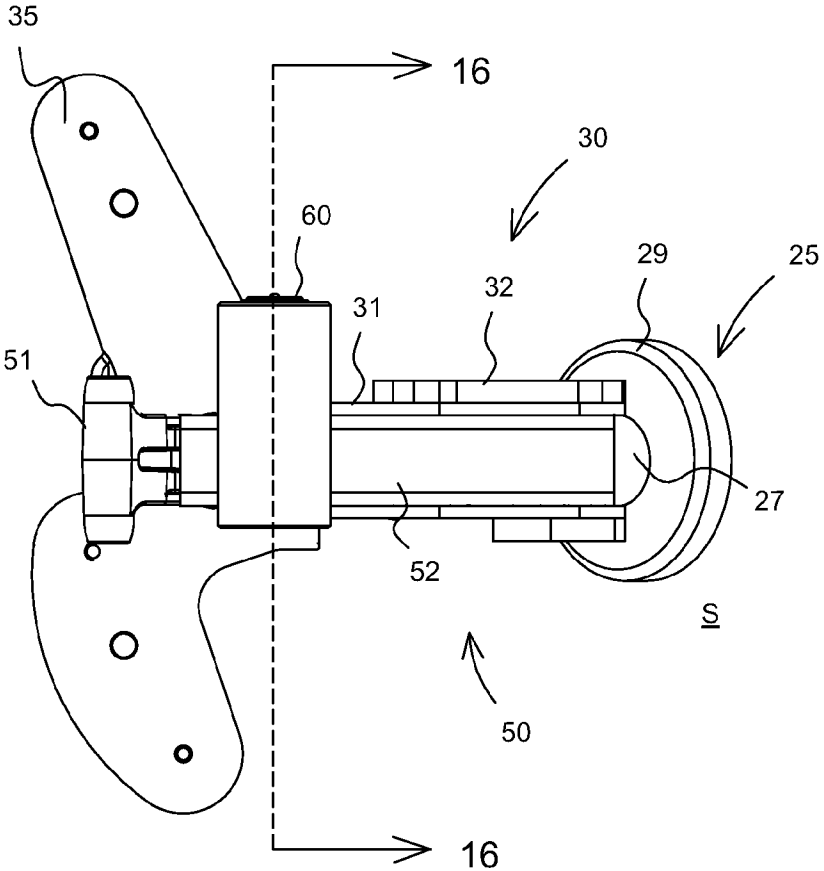
FIG. 15 is a representative side view of a firearm security device according to one preferred embodiment of the present invention.
Figure 18A:
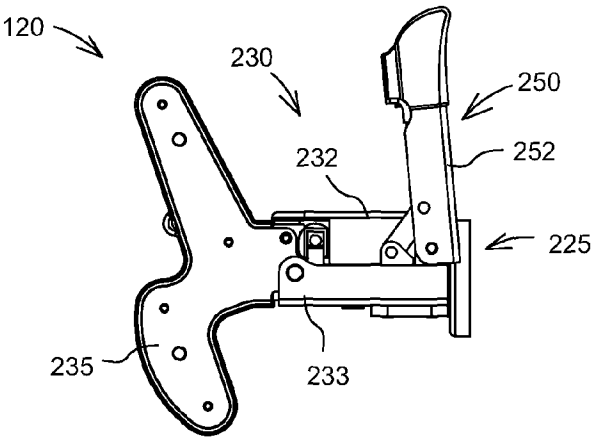
FIG. 18A is a representative side view of a firearm security device according to a preferred embodiment of the present invention.
Figure 18B:
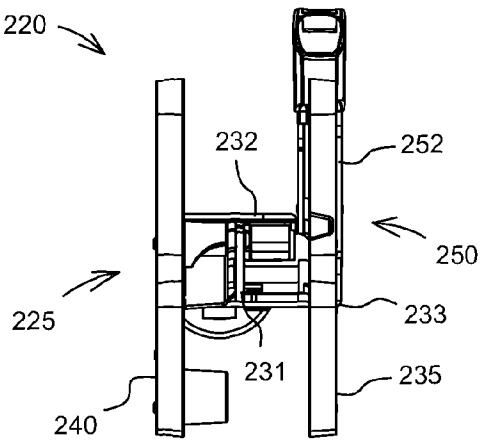
FIG. 18B is a representative front view of a firearm security device according to a preferred embodiment of the present invention.

FIG. 15 is a side view of firearm security device 20. FIG. 16 is a partial cutaway view of firearm security device 20. FIGS. 15 and 16 show the relationship between lock 60 and firearm security device 20. Firearm security device 20 includes frame assembly 30 having frame member 31 which is connected to spindle 27, shown in FIG. 15, of base assembly 25. Base assembly 25 mounts to surface S. Base security cover 29 is placed over spindle 27. Frame security cover plate 32 attaches to frame member 31. Movable plate 35, including second grip pad 36, as seen in FIG. 16, and fixed plate 40 including first grip pad 41 are also connected to frame member 31. Movable plate 35 may be shifted by operation of clamping assembly 50. Clamping assembly 50 includes pull 51, shown in FIG. 15, connected to lever 52. Bumper 48 can be seen in FIG. 16 extending from first grip pad 41 between fixed plate 40 and movable plate 35.

Lock 60 is attached to lever 52. More particularly and referring to FIG. 16, lock 60 includes lock housing 61 that is held in position with respect to lever 52 by set screw 63. Lever 52 is pivotably attached to movable plate 35 by means of linkage 55. Linkage 55 is pivotably attached to tab 37 by pin 59. Aperture 57 located at a distal end of tab 37 is adapted to project through slot 56 located in lever 52 and is engageable by bolt 65 of lock 60 to control access to a stored firearm.

Figure 17A:
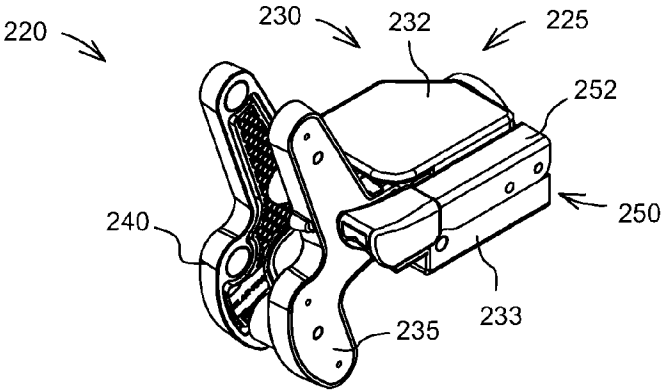
FIG. 17A is a representative perspective view of a firearm security device according to a preferred embodiment of the present invention.
Figure 17B:
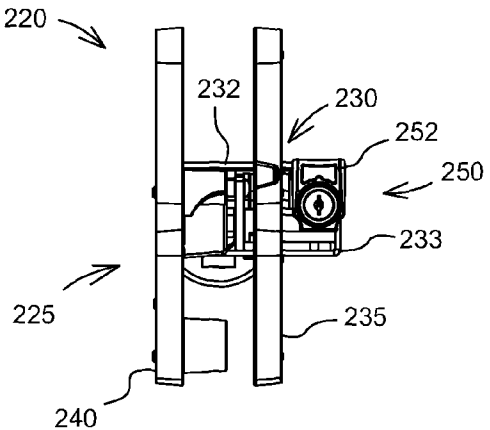
FIG. 17B is a representative front view of a firearm security device according to a preferred embodiment of the present invention.

FIGS. 17A-25 depict a second preferred embodiment of firearm security device 220 to advantage. Firearm security device 220 includes frame assembly 230. Base assembly 225 of firearm security device 220 mounts to a surface, (not shown). Movable plate 235 is shifted laterally from a closed position as seen in FIGS. 17A and 17B to an open position as seen in FIGS. 18A, 18B and 20-24, by operation of clamping assembly 250. Movable plate 235 is shifted laterally towards fixed plate 240 by operation of clamping assembly 250. In the preferred embodiment, clamping assembly 250 is designed having an over-center clamping action such that when lever 252 and associated linkage that connects lever 252 to movable plate 235 is advanced to an over-center position, clamping assembly 250 remains in a positive locked closed position with respect to fixed plate 240. FIG. 18B shows frame assembly 230 of firearm security device 220 including frame member 231 and frame security cover plate 232 and base and side cover plate 233, which restrict access to the interior of the frame when firearm security device 220 is in a closed position as shown in FIGS. 17A and 17B.

Figure 21A:
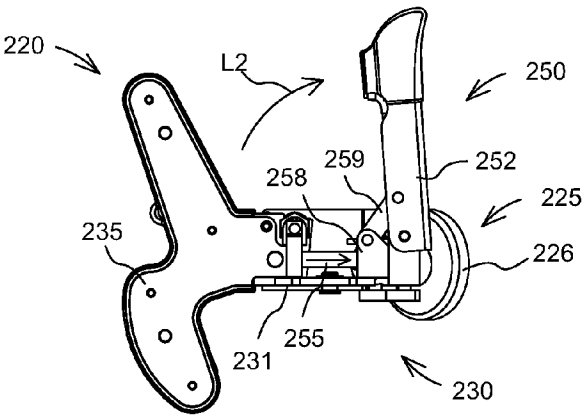
FIG. 21A is a representative side view of a firearm security device according to a preferred embodiment of the present invention.
Figure 21B:
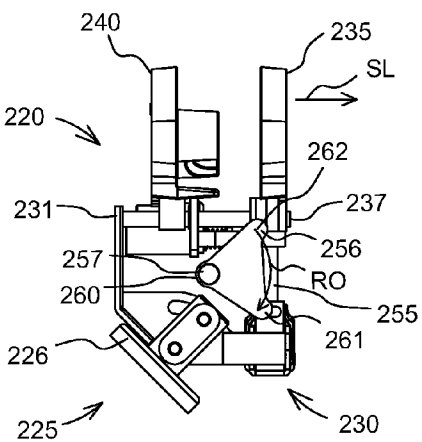
FIG. 21B is a representative bottom view of a firearm security device according to a preferred embodiment of the present invention.
Figure 19A:
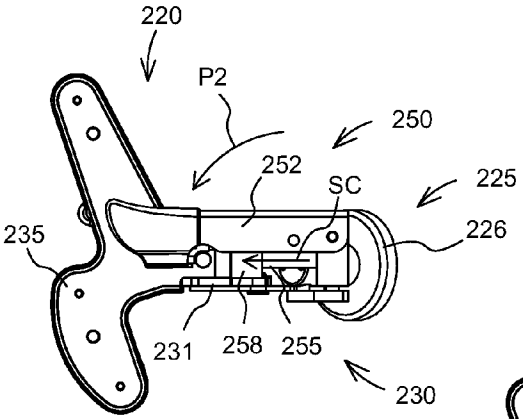
FIG. 19A is a representative side view of a firearm security device according to a preferred embodiment of the present invention.
Figure 19B:
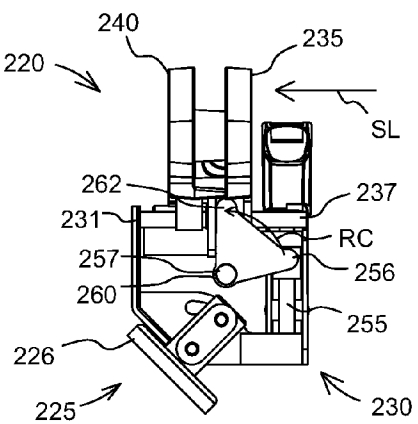
FIG. 19B is a representative bottom view of a firearm security device according to a preferred embodiment of the present invention.

FIGS. 19A-21B comprise a sequence of figures that depict operation of clamping assembly 250. In order to aid in the description of this operation, base and side cover plate 233, (shown in FIG. 17A-18B), is shown removed in FIGS. 19A-21B to reveal various parts of the referenced clamping assembly 250. FIGS. 19A and 19B show firearm security device 220 in a closed position. Lever 252 has been pushed to a closed position as indicated by the arrow P2. As seen in FIGS. 19B and 21B, bell crank 260 is pivotally attached to frame 231 at pivot 257. Handle linkage slide carriage 258 is attached to first bell crank arm 261 and movable plate 235 is attached to second bell crank arm 262. As shown in FIG. 19B, lever 252 is pushed towards a closed position and handle linkage slide carriage 258 is pushed forward along handle linkage slide rail 255 rotating bell crank 260 causing movable plate 235 to slide laterally, as indicated by the arrow SL, along clamp plate slide rail 237 with second bell crank arm 262 towards fixed plate 240. In the preferred embodiment, clamping assembly is configured such that lever 252 is held in a closed position by an over-center clamping action.

Figure 20:
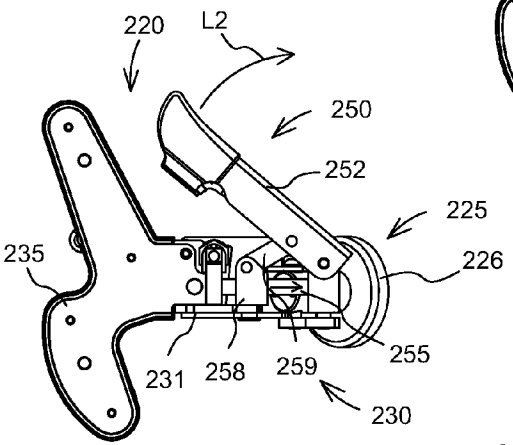
FIG. 20 is a representative side view of a firearm security device according to a preferred embodiment of the present invention.

FIG. 20 shows lever 252 lifted to a partially raised position as indicated by the arrow L2. As lever 252 is lifted, handle linkage slide carriage 258, shown attached to handle 252 by linkage 259 is pulled rearward along handle linkage slide rail 255. Referring to FIG. 21A shows lever 252 lifted to the fully open position, with handle linkage slide carriage 258, shown attached to handle 252 by linkage 259 pulled to a completely rearward position along handle linkage slide rail 255. As seen in FIG. 21B, bell crank 260 has rotated with the movement of handle linkage slide carriage 258 causing movable plate 235 to slide laterally, as indicated by the arrow SL, along clamp plate slide rail 237 with second bell crank arm 262 to a fully open position.

Figure 24:
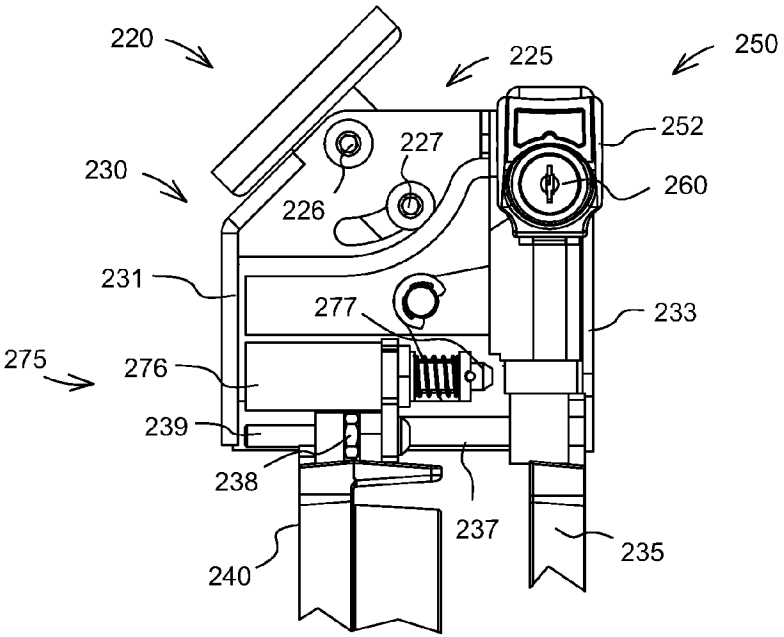
FIG. 24 is a representative top detail view of a firearm security device according to a preferred embodiment of the present invention.
Figure 22:
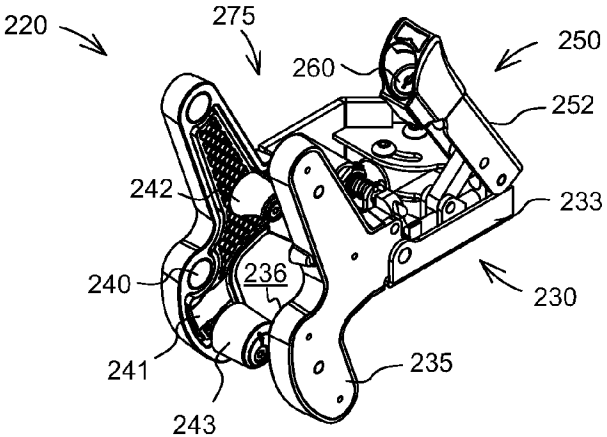
FIG. 22 representative perspective view of a firearm security device according to a preferred embodiment of the present invention.
Figure 23:
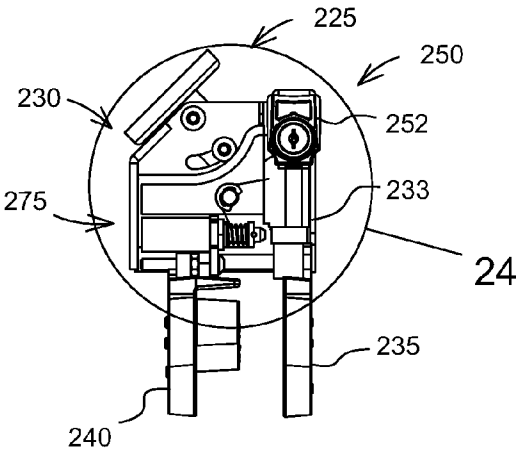
FIG. 23 is a representative top view of a firearm security device according to a preferred embodiment of the present invention.

FIGS. 22-24 show firearm security device 220 to advantage. Frame security cover plate 232, (shown in FIG. 17A-18B), is shown removed in FIGS. 22-24 to reveal various parts located beneath frame security cover plate 232 housed within frame assembly 230. Also shown in FIG. 22 are trigger guard stud 242 and grip support pad 243 attached to fixed plate 240 projecting from an inner surface of first grip pad 241. Second grip pad 236 is shown attached to movable plate 235. Grip support pad 243 is configured having a generally circular cross-section and is mounted to fixed plate 240 eccentrically such that as grip support pad 243 is rotated, such that an upper surface of grip support pad 243 raises or lowers to accommodate various grip configurations of firearms to be stored in firearm security device 220.

FIGS. 23 and 24 show frame assembly 230 of firearm security device 220 including frame member 231, pivotably connected to base assembly 225. Referring to FIG. 24, base plate 226 of base assembly 225 can be seen secured to frame 231 by screws 227 and 228. An angle of frame 231 with respect to base assembly 225 may be modified by loosening screws 227 and 228 adjusting frame 231 to a desired angle and retightening the screws.

FIG. 24 also shows several additional features of firearm security device 220. In particular, closed distance CD between movable plate 235 and fixed plate 240 may be adjusted to accommodate firearms having receivers of various widths by advancing fixed plate along threaded shaft 239 by rotation, (or counter-rotation), of adjustment nut 238. FIG. 24 also shows remotely operated lock system 275 including solenoid 276 having throw rod 277. Remotely operated lock system 275 my serve as an auxiliary to lock 260 or may in some embodiments replace lock 260 and serve as a primary locking mechanism for firearm security device 220. In the embodiment shown in FIG. 24, remotely operated lock system 275 is remotely controlled and operated. Solenoid 276 must be energized withdrawing an end of throw rod 277 from locking engagement with handle 252, before handle 252 may be operated, by first unlocking lock 260 and then by lifting handle 252.

Figure 25:
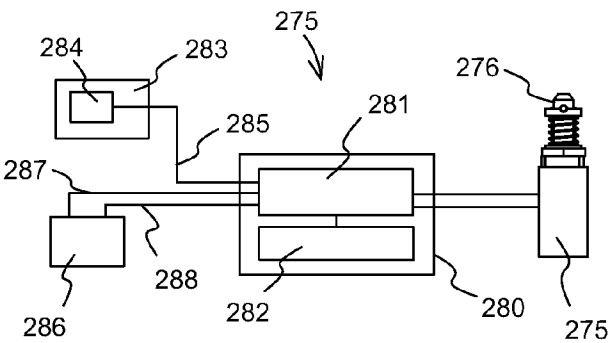
FIG. 25 is a schematic diagram showing features of the remote locking circuit of a firearm security device according to a preferred embodiment of the present invention.

FIG. 25 shows remotely operated lock system 275 including control circuit 280. An actuator including a rod that may be extended and withdrawn is controlled by control circuit 280 to selectively restrict and/or permit movement of second movable plate 235 with respect to fixed plate 240, (shown in FIG. 24). Any of a variety of electrical, pneumatic or hydraulically controlled devices may serve as an actuator. In the preferred embodiment, the actuator comprises solenoid 276 including throw rod 277. Solenoid 276 is adapted to retract throw rod 277 when control circuit 280 applies power from power source 286, to solenoid 276. In a preferred embodiment, throw rod 277 is maintained in a retraced position solenoid 276. In the embodiment shown in FIGS. 22-25, solenoid 276 is operated by control circuit 280 to retract throw rod 277. A user would then have a set period of time to access the firearm by unlocking manual lock 260.

Remotely operated lock system 275 also includes unlock signal generator 283 including a battery power supply 284. Control circuit 280 includes processor 281. First conductor 287 and second conductor 288 conductively connects power source 286 to processor 281. Third conductor 285 conductively connects unlock signal generator 283 to processor 281. Processor 281 is programmed to look for a valid unlock signal from unlock signal generator 283 before applying an opening current to solenoid 276. This feature of the invention prevents an override of control circuit 280 in order to operate solenoid 276. Upon receipt and verification of a valid unlock signal, processor 281 causes an opening current and voltage to be applied to solenoid 276 retracting throw rod 277 for a programmed duration. In a preferred embodiment of the invention, a reduced power level is employed to maintain throw rod 277 in a retracted position for the programmed duration. For instance, a reduced power level may be achieved by pulsing current at a rate of 400 hertz with a 25% duty cycle. After the programmed time duration for maintaining throw rod 277 in a retracted position passes, throw rod 277 returns to a locked position.

Control circuit 280 may also include memory 282 adapted to maintain data representative of a variety operations related data including security and access codes, times at which remotely operated lock system 275 operated and/or access or user codes applied to operate remotely operated lock system 275.

The foregoing description of the illustrated embodiments has been presented for purposes of illustration and description. It is not intended to be exhaustive or to limit the invention to the precise form or to exemplary embodiment(s) and implementation(s) disclosed. Numerous modifications and variations will be apparent to practitioners skilled in this art. Elements described might be interchangeable with other elements in order to achieve the same result. At least one preferred embodiment was chosen and described in order to best explain the principles of the invention and a best mode of practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph unless the element is expressly recited using the phrase "means for . . . ."

What is claimed is:

1. A firearm security device attachable to a surface for securing a firearm including a trigger guard, a receiver and a grip, the firearm security device comprising:

a frame;

a first plate connected to the frame, the first plate including a first grip pad;

a trigger guard stud attached to the first plate, the trigger guard stud projecting from an inner surface of the first grip pad, the trigger guard stud adapted for insertion through the trigger guard of the firearm;

a firearm support member projecting from the first grip pad, the firearm support member adapted for positioning below the receiver of the firearm;

a second plate including a second grip pad, the second plate connected to the frame; and a clamping assembly including a lever connected to the frame and linked to the second plate, the second plate moveable by operation of the lever from an open position to a closed position wherein the second plate is moved to a position substantially parallel to and opposing the first plate, the second plate held in a closed position by an over-center clamping action of the clamping assembly.

2. The firearm security device of claim 1 wherein the second plate is laterally moveable relative to the first plate by operation of the lever.

3. The firearm security device of claim 1 wherein the second plate is pivotably moveable relative to the first plate by operation of the lever.

4. The firearm security device of claim 1 further comprising a lock adapted to selectively restrict movement of the second plate relative to the first plate.

5. The firearm security device of claim 1 further comprising a lock adapted to selectively restrict movement of the lever.

6. The firearm security device of claim 1 further comprising a remotely operated lock adapted to selectively restrict movement of the second plate relative to the first plate.

7. The firearm security device of claim 1 further comprising a remotely operated lock adapted to selectively restrict or permit movement of the lever.

8. The firearm security device of claim 1 further comprising:

a remotely operated lock attached to the frame, the remotely operated lock including an actuator adapted to selectively restrict movement of the lever; and a control circuit electrically connected to a power source and the actuator for selectively energizing and de-energizing the actuator to selectively restrict movement of the second plate relative to the first plate.

9. The firearm security device of claim 1 further comprising:

a remotely operated lock attached to the frame, the remotely operated lock including an actuator adapted to selectively restrict movement of the lever; and a control circuit electrically connected to a power source and the actuator for selectively energizing and de-energizing the actuator to selectively restrict movement of the lever.

10. A firearm security device attachable to a surface for securing a firearm including a trigger guard, a receiver and a grip, the firearm security device comprising:

a frame;

a base assembly connected to the frame, the base assembly attachable to the surface;

a first plate connected to the frame, the first plate including a first grip pad;

a trigger guard stud attached to the first plate, the trigger guard stud projecting from an inner surface of the first grip pad, the trigger guard stud adapted for insertion through the trigger guard of the firearm;

a firearm support member projecting from the first grip pad, the firearm support member adapted for positioning below the receiver of the firearm;

a second plate including a second grip pad, the second plate connected to the frame; and a clamping assembly including a lever connected to the frame and linked to the second plate, the second plate moveable laterally with respect to the first plate by operation of the lever from an open position wherein the firearm is positionable against the inner face of the first plate with the trigger guard stud projecting through the trigger guard of the firearm, to a closed position wherein the second plate moves laterally to a position substantially parallel to and opposing the first plate, at least a portion of the receiver of the firearm held in a compressive grip between the first plate and the second plate, the second plate held in a closed position by an over-center clamping action of the clamping assembly.

11. The firearm security device of claim 10 further comprising a lock adapted to selectively restrict movement of the second plate relative to the first plate.

12. The firearm security device of claim 10 further comprising a lock adapted to selectively restrict movement of the lever.

13. The firearm security device of claim 10 further comprising a remotely operated lock adapted to selectively restrict movement of the second plate relative to the first plate.

14. The firearm security device of claim 10 further comprising a remotely operated lock adapted to selectively restrict or permit movement of the lever.

15. The firearm security device of claim 10 further comprising:

a remotely operated lock attached to the frame, the remotely operated lock including an actuator adapted to selectively restrict movement of the lever; and a control circuit electrically connected to a power source and the actuator for selectively energizing and de-energizing the actuator to selectively restrict movement of the second plate relative to the first plate.

16. The firearm security device of claim 10 further comprising:

a remotely operated lock attached to the frame, the remotely operated lock including an actuator adapted to selectively restrict movement of the lever; and a control circuit electrically connected to a power source and the actuator for selectively energizing and de-energizing the actuator to selectively restrict movement of the lever.

17. A firearm security device attachable to a surface for securing a firearm including a trigger guard, a receiver and a grip, the firearm security device comprising:

a frame;

a base assembly connected to the frame, the base assembly attachable to the surface;

a first plate connected to the frame, the first plate including a first grip pad;

a trigger guard stud attached to the first plate, the trigger guard stud projecting from an inner surface of the first grip pad, the trigger guard stud adapted for insertion through the trigger guard of the firearm;

a firearm support member projecting from the first grip pad, the firearm support member adapted for positioning below the receiver of the firearm;

a second plate including a second grip pad, the second plate connected to the frame; and a clamping assembly including a lever connected to the frame and linked to the second plate, the second plate moveable by operation of the lever from an open position wherein the firearm is positionable against the inner face of the first plate with the trigger guard stud projecting through the trigger guard of the firearm, to a closed position wherein the second plate is moved to a position substantially parallel to and opposing the first plate, at least a portion of the receiver of the firearm held in a compressive grip between the first plate and the second plate, the second plate held in a closed position by an over-center clamping action of the clamping assembly.

18. The firearm security device of claim 17 further comprising a lock adapted to selectively restrict movement of the second plate relative to the first plate.

19. The firearm security device of claim 17 further comprising a remotely operated lock adapted to selectively restrict movement of the lever.

20. The firearm security device of claim 1 further comprising:

a remotely operated lock attached to the frame, the remotely operated lock including an actuator adapted to selectively restrict movement of the lever; and a control circuit electrically connected to a power source and the actuator for selectively energizing and de-energizing the actuator to selectively restrict movement of the second plate relative to the first plate.

* * * * *